US006004060A

United States Patent [19]

Bedol

[11] Patent Number: 6,004,060

[45] **Date of Patent: *Dec. 21, 1999**

[54] ORGANIZER ASSEMBLY FOR REMOVABLE ATTACHMENT TO A RINGED NOTEBOOK OR RINGED BINDER

[76] Inventor: Mark A. Bedol, 3423 Yankton Ave., Claremont, Calif. 91711

[ * ] Notice: This patent is subject to a terminal disclaimer.

[21] Appl. No.: 09/193,102

[22] Filed: Nov. 16, 1998

Related U.S. Application Data

[63] Continuation of application No. 08/769,504, Dec. 18, 1996.

[51] Int. Cl.[6] ..... B42F 3/00

[52] U.S. Cl. ..... 402/4; 402/79; 281/51; 281/38

[58] Field of Search ..... 402/4, 79; 281/38, 281/51, 28, 21.1; 283/117; D19/32; D18/2

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,894,241 | 1/1933 | Raynolds | 402/80 L |
| 1,904,572 | 4/1933 | Trussell | 402/4 |
| 2,097,626 | 11/1937 | Lesti | 402/4 |
| 2,160,392 | 5/1939 | Schade | 129/1 |
| 2,184,823 | 12/1939 | Vernon | 129/1 |
| 2,194,003 | 3/1940 | Brooks | 281/3 |
| 2,200,146 | 5/1940 | Block | 281/30 |
| 2,223,560 | 12/1940 | Friedlaender | 281/31 |
| 2,276,987 | 3/1942 | Kengott | 129/4 |
| 2,318,192 | 5/1943 | Boelema, Jr. | 281/31 |
| 2,453,459 | 11/1948 | Roberts | 129/4 |
| 2,505,694 | 4/1950 | Stuercke | 129/4 |
| 2,647,517 | 8/1953 | Bilbrey | 129/1 |
| 2,673,099 | 3/1954 | Hamilton | 281/15 |
| 2,704,077 | 3/1955 | Prillaman | 129/1 |
| 2,821,197 | 1/1958 | Bilbrey | 129/1 |
| 3,126,891 | 3/1964 | Caputi | 129/1 |
| 3,366,118 | 1/1968 | Beyer | 129/4 |
| 4,157,757 | 6/1979 | Gallaher, Jr. | 206/328 |

(List continued on next page.)

FOREIGN PATENT DOCUMENTS

| | | | |
|---|---|---|---|
| 835316 | 12/1938 | France | 402/4 |
| 64148 | 10/1955 | France | 402/4 |
| 1396190 | 3/1965 | France | 402/4 |
| 2575419 | 7/1986 | France | 402/80 R |
| 817440 | 10/1951 | Germany | 402/4 |
| 17022 | of 1909 | United Kingdom | 402/4 |
| 7081 | of 1910 | United Kingdom | 281/30 |
| 11652 | of 1912 | United Kingdom | 281/30 |
| 217484 | 6/1924 | United Kingdom | 402/4 |
| 1564220 | 4/1980 | United Kingdom | 281/30 |

OTHER PUBLICATIONS

NiteOwl™ lighted notepad, Lumatec Industries, Inc., PO Box 279 Austin, Texas 78767–9830. Owner's Manual plus two photographs of device.

*Primary Examiner*—Willmon Fridie, Jr.

[57] ABSTRACT

An organizer assembly for removable attachment to a host ringed notebook or ringed binder having a plurality of rings. The ringed notebook or ringed binder is of the type having a front cover and rear cover with looseleaf pages positionable therebetween, the looseleaf pages having smaller perimeters than the covers. The organizer assembly includes an organizer insert assembly attachable to the rings of the ringed binder or ringed notebook. The insert assembly assembly includes a relatively thin plate member having a side edge. The insert assembly further has a terminal section thereon which depends from the side edge and extends beyond the perimeter of the looseleaf pages. The terminal section has an increased thickness so as to fill a portion of a void between the front and rear covers.

5 Claims, 12 Drawing Sheets

U.S. PATENT DOCUMENTS

| | | | |
|---|---|---|---|
| 4,430,015 | 2/1984 | Nerlinger | 402/79 |
| 4,555,018 | 11/1985 | Cho | 206/214 |
| 4,595,309 | 6/1986 | Chinchar | 402/80 R |
| 4,704,042 | 11/1987 | Eisen et al. | 402/79 |
| 4,820,071 | 4/1989 | Steinfield et al. | 402/4 |
| 4,909,652 | 3/1990 | Harrison | 402/80 R |
| 4,918,632 | 4/1990 | York | 364/708 |
| 5,058,736 | 10/1991 | Bedol | 206/214 |
| 5,118,138 | 6/1992 | Brotz | 281/51 |
| 5,118,213 | 6/1992 | Merservy et al. | 402/80 R |
| 5,209,592 | 5/1993 | Bedol | 402/1 |
| 5,316,341 | 5/1994 | Schwartz | 281/15.1 |
| 5,409,319 | 4/1995 | Bedol | 402/1 |
| 5,460,414 | 10/1995 | Sargis | 281/38 |
| 5,476,336 | 12/1995 | Osiecki et al. | 402/79 |
| 5,498,089 | 3/1996 | Motyka | 402/4 |
| 5,503,489 | 4/1996 | Maudal | 402/80 L |
| 5,597,256 | 1/1997 | Burton et al. | 402/4 |
| 5,695,294 | 12/1997 | Bedol et al. | 402/79 |
| 5,839,843 | 11/1998 | Bedol | 402/4 |
| 5,876,144 | 3/1999 | Bedol et al. | 402/4 |

74
75
76
72
78
14
14
68
13
13
70
71
70
71
72

76

78

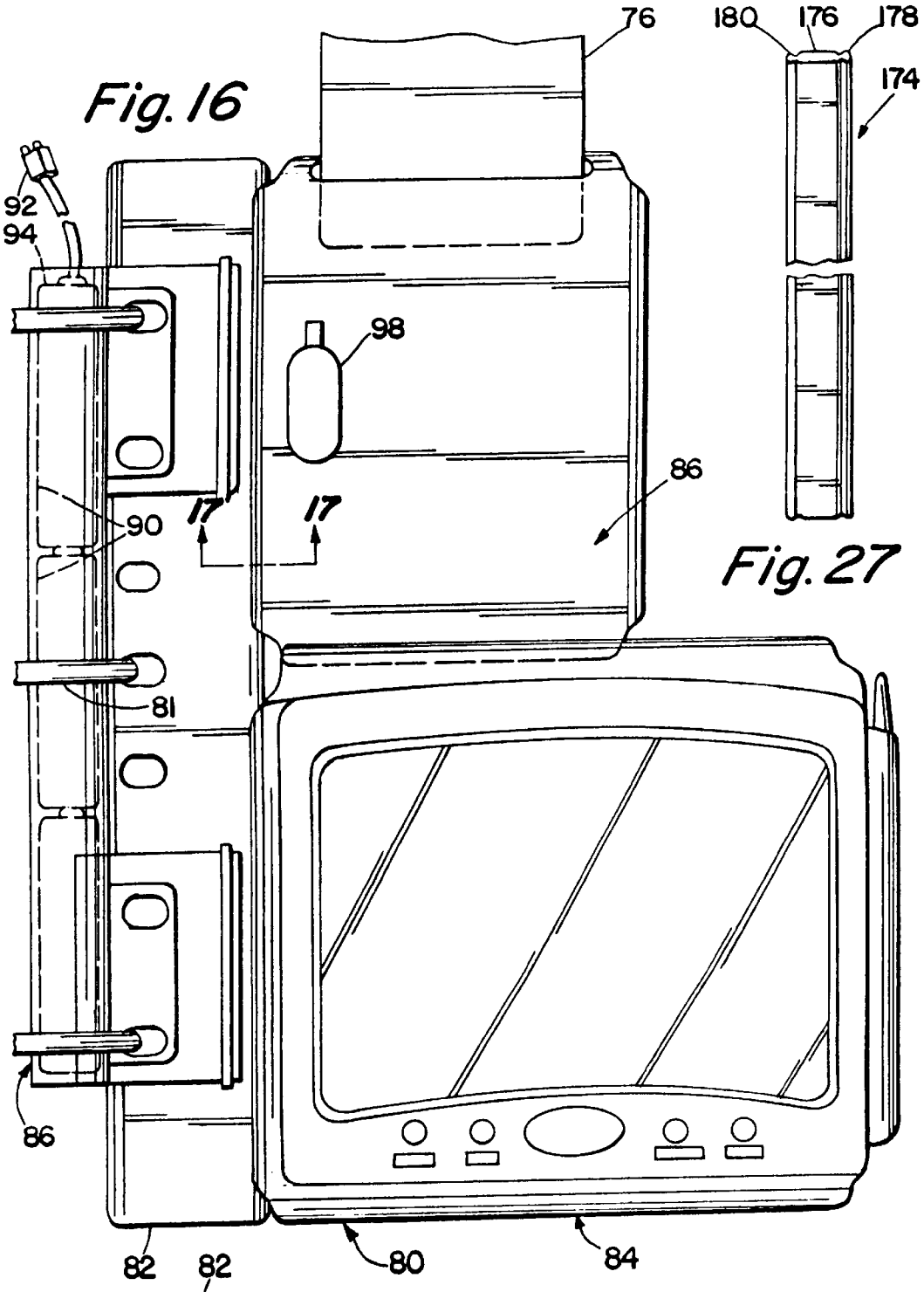
Fig. 16
Fig. 27
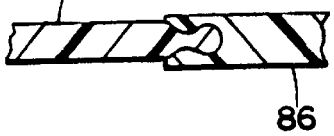
Fig. 17

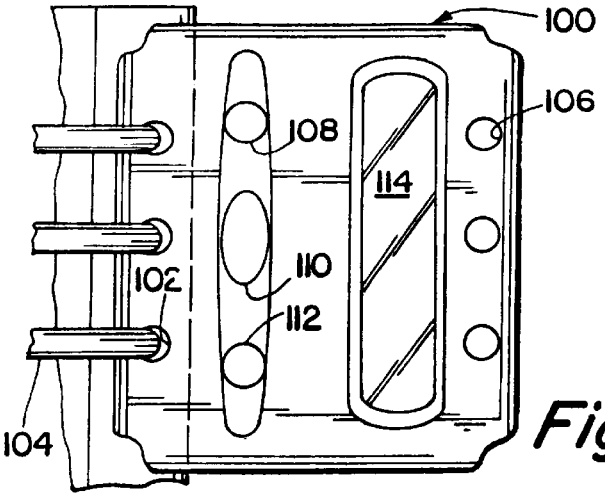
Fig. 18
Fig. 20
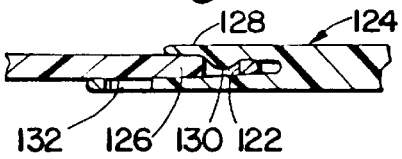
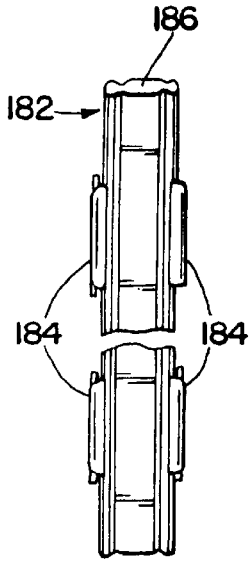
Fig. 28
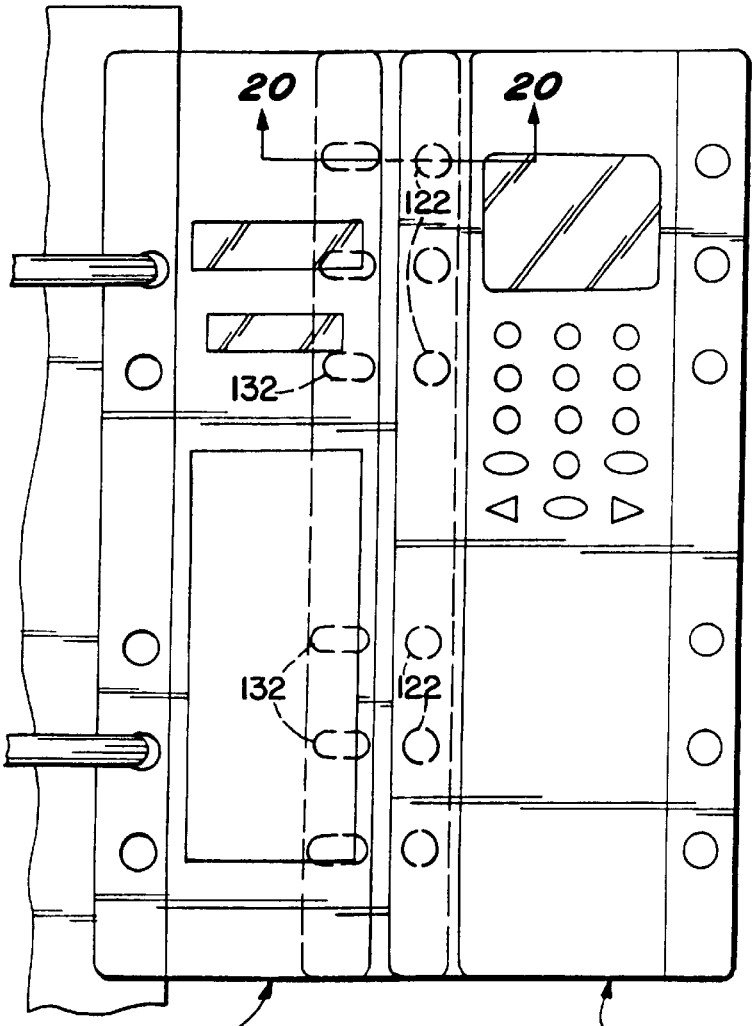
Fig. 19
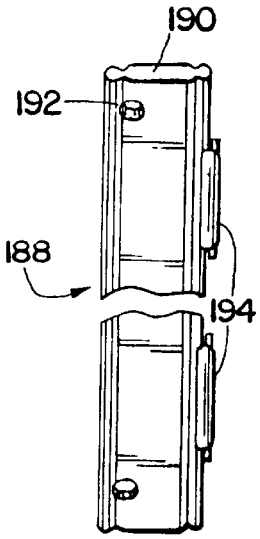
Fig. 29

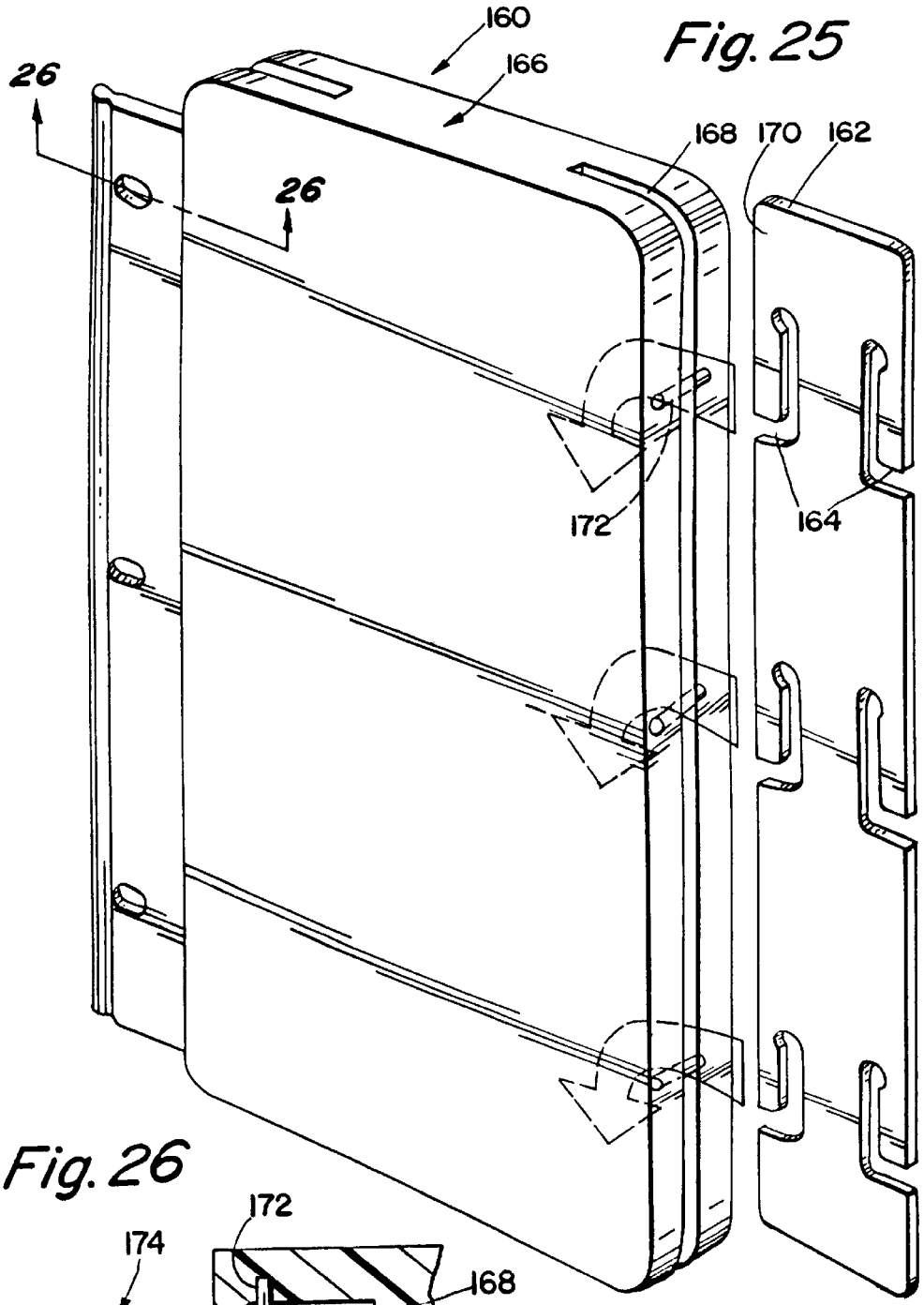
Fig. 25
Fig. 26
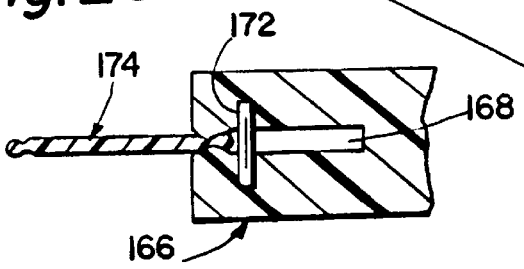

37
36
36
202
37
198
204

198
208

202

202

204
196
34
34
198
35
35
208
START
PAUSE
STOP
PLAY REC
RESET
SPKR
CHAN
MIC
206

202
205
41
41

205 202

210
211

210
45
45
43
210

44
44
210
43

ORGANIZER ASSEMBLY FOR REMOVABLE ATTACHMENT TO A RINGED NOTEBOOK OR RINGED BINDER

This application is a Continuation of application Ser. No. 08/769,504, filed on Dec. 18, 1996.

BACKGROUND OF THE INVENTION

1. Field of the Invention

The present invention relates to inserts for ringed notebooks and ringed binders and, more particularly, to an organizer assembly which provides removable attachment of selected items to the rings of the notebook or binder, for providing various functions.

2. Description of the Related Art

Users of notebooks, including businessmen and students, often desire to have various articles such as pencils and pens at their easy disposal when they use their notebook and to be secure from being lost when they carry their notebooks from one location to another.

In partial solution to this problem, present applicant Mark A. Bedol, invented a "Notebook Organizer Including Slidable Element", U.S. Pat. No. 5,058,736. The U.S. Pat. No. 5,058,736 discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

Although these prior art devices are effective in attempting to maximize the usable space within a notebook, with the miniaturization now possible with various electronic devices it has become more desirable to attempt to provide space for these items within a notebook. The ability to provide the user with the opportunity to selectively secure desired devices with the notebook has heretofore not been exploited.

OBJECTS AND SUMMARY OF THE INVENTION

It is, therefore, a principal object of the present invention to provide a modular system for the users of notebooks or binders and thus provide the opportunity for these users to create their own configuration of electronic and other devices commensurate with their individual workstyle/needs.

In one broad aspect, the present invention is an organizer assembly for removable attachment to a host ringed notebook or ringed binder having a plurality of rings. The ringed notebook or ringed binder is of the type having a front cover and rear cover with looseleaf pages positionable therebetween, the looseleaf pages having smaller perimeters than the covers. The organizer assembly includes an organizer insert assembly attachable to the rings of the ringed binder or ringed notebook. The insert assembly assembly includes a relatively thin plate member having a side edge. The insert assembly further has a terminal section thereon which depends from the side edge and extends beyond the perimeter of the looseleaf pages. The terminal section has an increased thickness so as to fill a portion of a void between the front and rear covers.

As will be explained below, the present invention provides a number of modular configurations so that desired configurations can be obtained in accordance with the user's needs.

Other objects, advantages, and novel features will become apparent from the following detailed description of the invention when considered in conjunction with the accompanying drawings.

BRIEF DESCRIPTION OF THE DRAWINGS

FIG. 16 is a front perspective view of a spine and rings of a notebook in association with an electronic template pen—based organizer, memory storage device and battery storage device, all in accordance with the principles of the present invention.

FIG. 17 is a view taken along Line 17—17 of FIG. 16.

FIG. 18 is a front perspective illustration of a pager clipped to the rings of a ringed binder, in accordance with the principles of the present invention.

FIG. 19 is a front perspective illustration of a calculator and clock assembled together and clipped to the rings of a ringed binder, also in accordance with the principles of the present invention.

FIG. 20 is a view taken along Line 20—20 of FIG. 19.

FIG. 25 is a perspective view of an electronic device in association with an alternative adapter having channels formed therein.

FIG. 26 is a view taken along Line 26—26 of FIG. 25.

FIG. 27 is a perspective view of another alternative adapter having two male sides.

FIG. 28 is a perspective view of an alternative adapter having releasable hinge assemblies thereon.

FIG. 29 is another type of hinge adapter which has openings for securement to rings and also has releasable hinge assemblies.

The same parts or elements throughout the drawings are designated by the same reference characters.

DETAILED DESCRIPTION OF THE PREFERRED EMBODIMENTS

Figure 1:
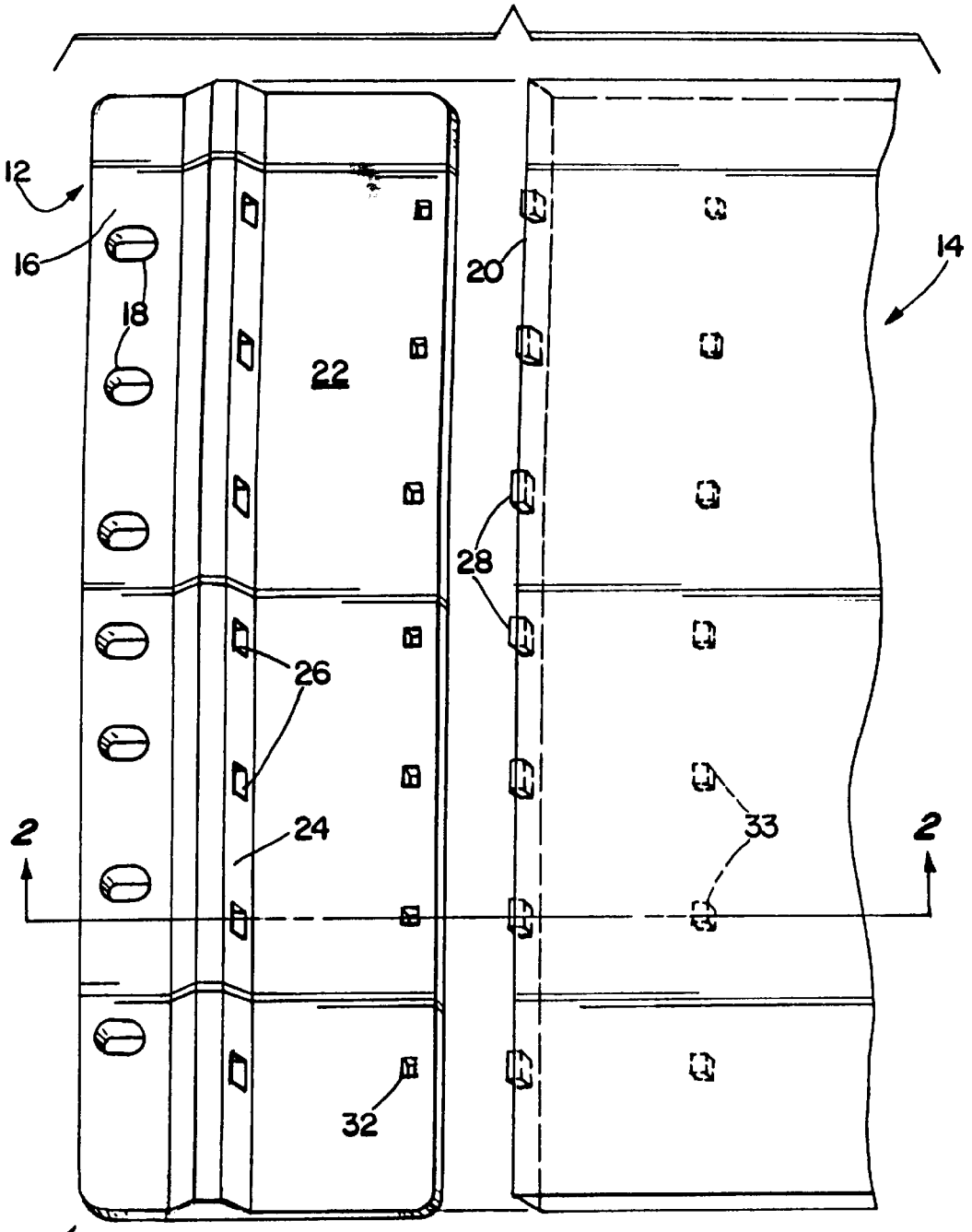
FIG. 1 is a front, exploded perspective view of a first embodiment of the present invention, the adapter having a raised portion thereon.
Figure 2:
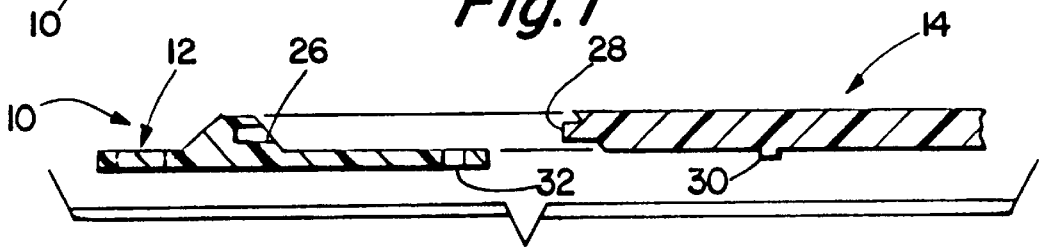
FIG. 2 is a view taken along Line 2—2 of FIG. 1.
Figure 3:
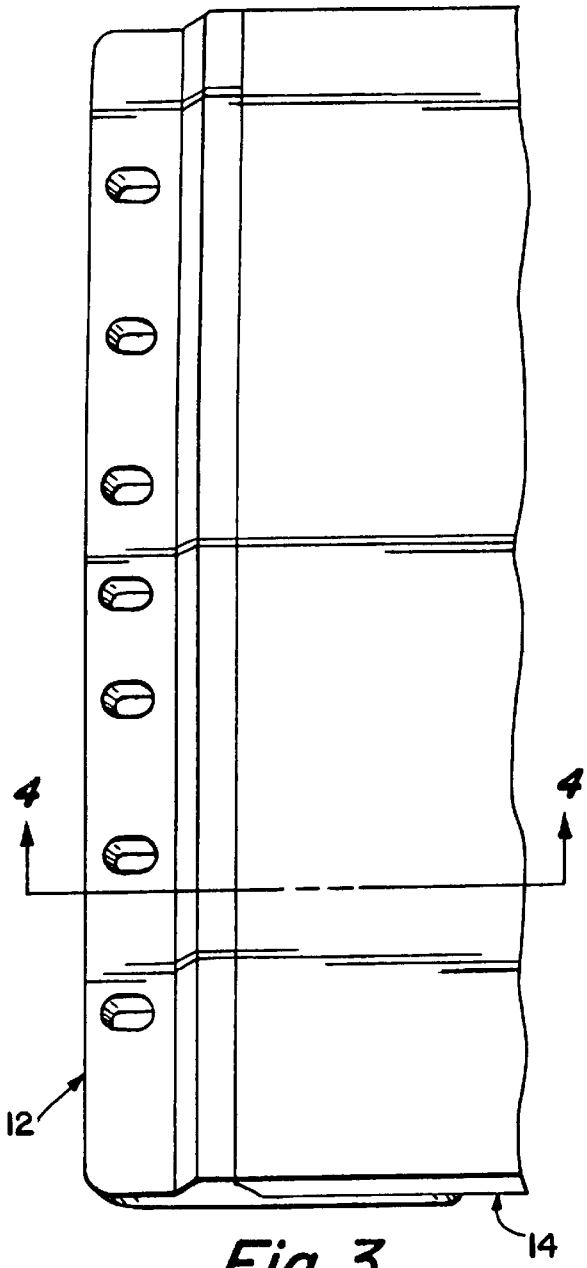
FIG. 3 illustrates the assembly of FIG. 1, shown assembled.
Figure 4:
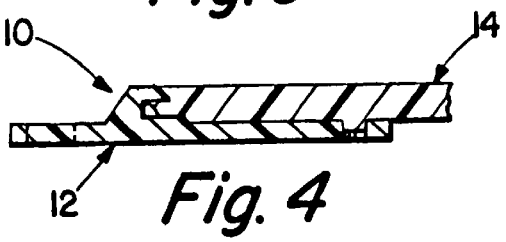
FIG. 4 is a view taken along Line 4-4 of FIG. 3.

Referring now to the drawings and the characters of reference marked thereon, FIG. 1 illustrates a first embodiment of the assembly of the present invention, designated generally as 10. The organizer assembly 10 provides removable attachment to a host ringed notebook or ringed binder having a plurality of rings. The assembly 10 comprises an adapter 12 and a selected item 14. The adapter 12 has a first portion 16 having a plurality of spaced openings 18 therethrough. The spaced openings 18 are so arranged and sized so as to accommodate the rings of a ringed notebook or ringed binder. The selected item 14 has a mating edge 20 which is attachable to a second portion of the adapter, as will be described below, such that the selected item may be securely attached to the adapter via the mating edge 20 and detachable therefrom when desired. The adapter 12, in this first embodiment, includes a plate member 22 and a longitudinally extending raised portion 24 extending from an upper surface of the plate member 22. The raised portion 24 has a plurality of indents 26 formed therein for receiving mating edge projections 28 formed on the mating edge 20. The selected item 14 includes locking projections 30 which are received in mating openings 32 formed in the plate member 22. These relationships can be easily seen with reference to FIG. 2. FIGS. 3 and 4 show the adapter 12 in locking engagement with the selected item 14.

The selected item 14 may include, for example, an electronic calculator, a clock, an appointment reminder, a digital sound recorder, a databank, a small miniaturized television, an internet access device, an electronic template or pen-based organizer, storage for various types of flash memory cards, such as PCMICA (Personal Computer Memory Card International Association) cards, a pager, a cellular phone, a digital camera, a paper or page scanner, or a printer.

Figure 5:
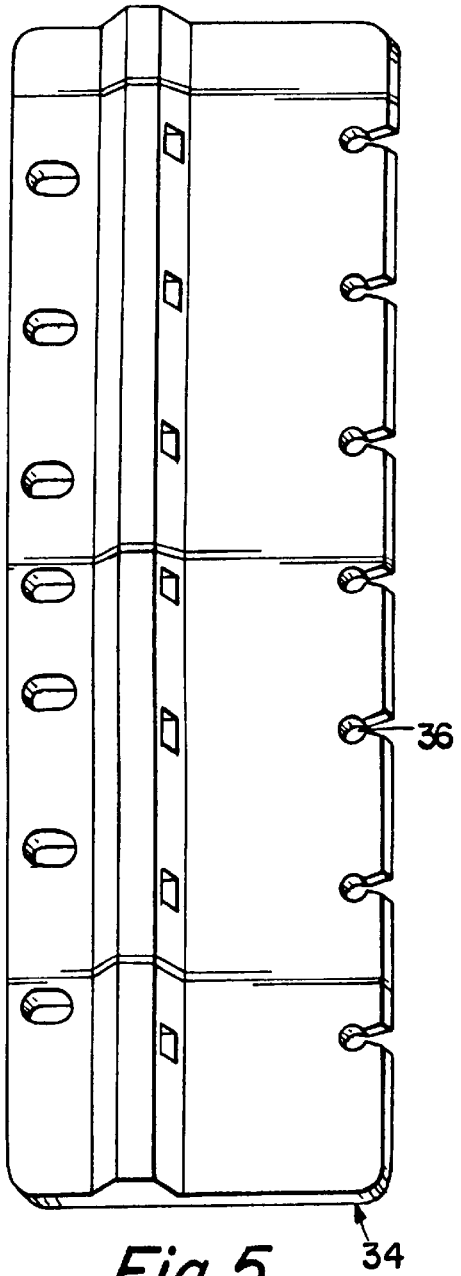
FIG. 5 is a front perspective view of a second embodiment of an adapter using a keyhole shape mating opening.

Referring now to FIG. 5, an alternative adapter is illustrated, designated generally as 34. In this embodiment, the mating openings 36 are keyhole shaped. Use of this keyhole shape is advantageous if the locking projection on the selected device is a round configuration.

Figure 6:
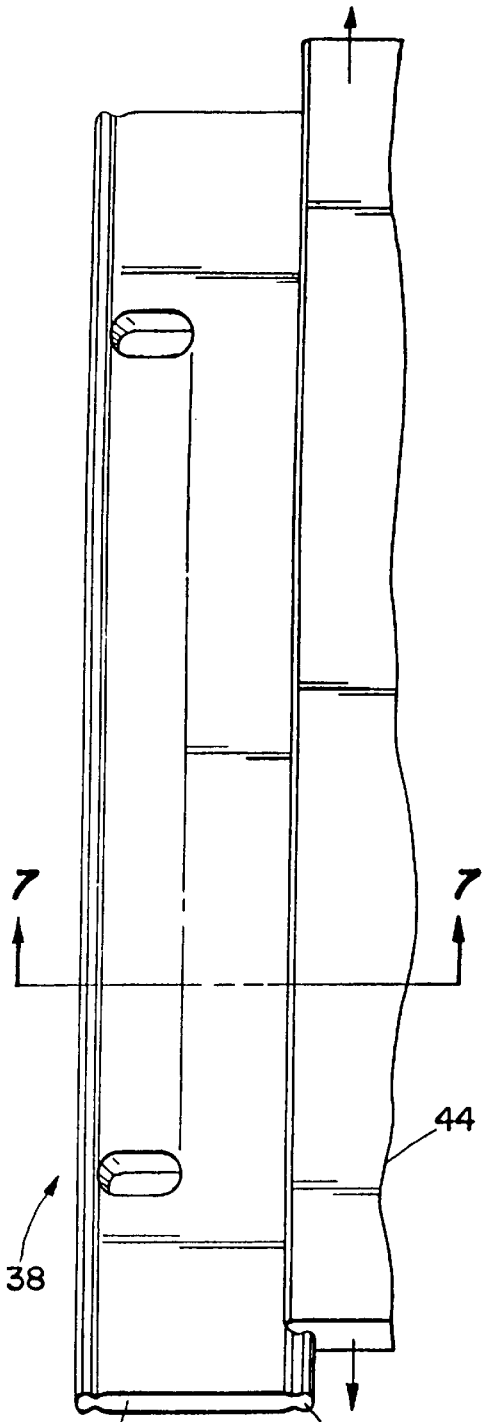
FIG. 6 is a partial front perspective view of a third embodiment in which the adapter utilizes a slide mechanism for attachment with a desired device.
Figure 8:
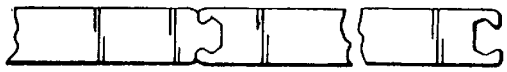
FIG. 8 is a cross-sectional view of an alternative sliding mechanism.
Figure 9:
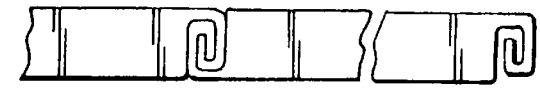
FIG. 9 is a cross-section of another alternative sliding mechanism.
Figure 7:
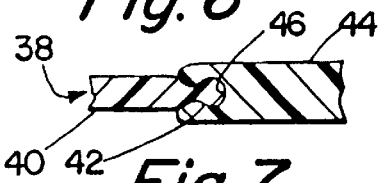
FIG. 7 is a view taken along Line 7—7 of FIG. 6.

Referring now to FIG. 6, another embodiment of the present invention is illustrated, designated generally as 38. In this instance, the adapter comprises a plate member or flange 40 having an elongated slide engaging member or elongated rod 42 on an edge thereof. The selected item 44 comprises a slide portion or slotted channel 46 (see FIG. 7) which is profiled to provide a complimentary sliding fit when engaged with the slide engaging member 42. Various slide mechanisms may be used, such as those illustrated as indicated by numeral designations 48, 50 in FIGS. 8 and 9, respectfully.

Figure 10:
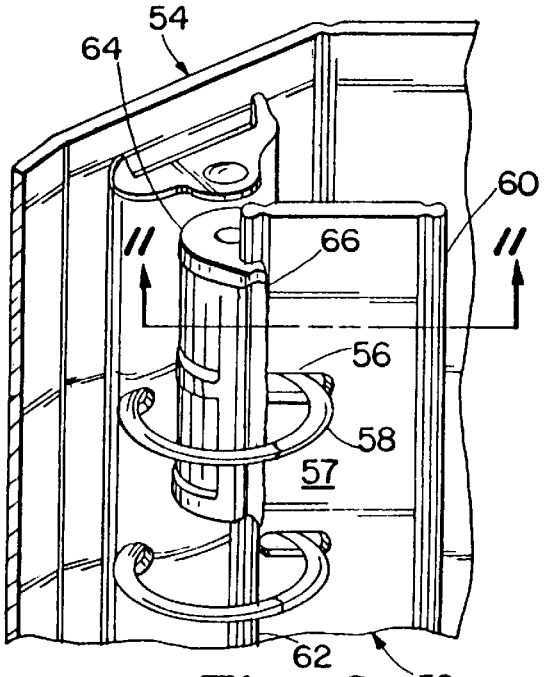
FIG. 10 is perspective view of a notebook containing a tape dispenser designed in accordance with the principles of the present invention.
Figure 11:
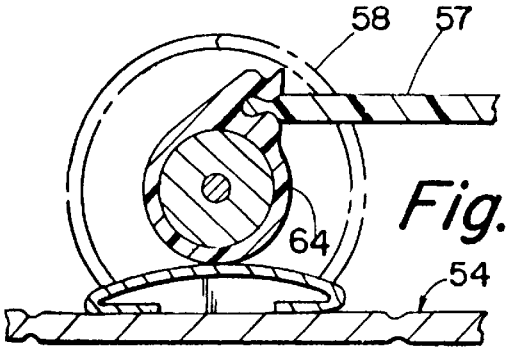
FIG. 11 is a view taken along Line 11—11 of FIG. 10.

FIG. 10 illustrates another embodiment of the present invention, in the form of a tape dispenser assembly, designated generally as 52. The tape dispenser assembly 52 is shown engaged in a ringed notebook, designated generally as 54. A first portion 56 of the adapter includes openings for engaging the rings 58 of the binder 54. A second portion 60 of the adapter 57 provides means for attaching a selected item. And, a third portion 62 of the adapter 57 includes means for attaching a second selected item (i.e. roll of tape 64) to the adapter 57. A serrated edge 66 of the tape dispenser unit 64 is included for efficient cutting of the tape. This tape dispenser unit is efficiently stored within the volume of the rings of the ringed binder. This is easily seen by reference to FIG. 11. Thus, use of these slide engaging members provides efficient means for attaching selected items to the organizer assembly.

Figures 12, 13, 14, 15:
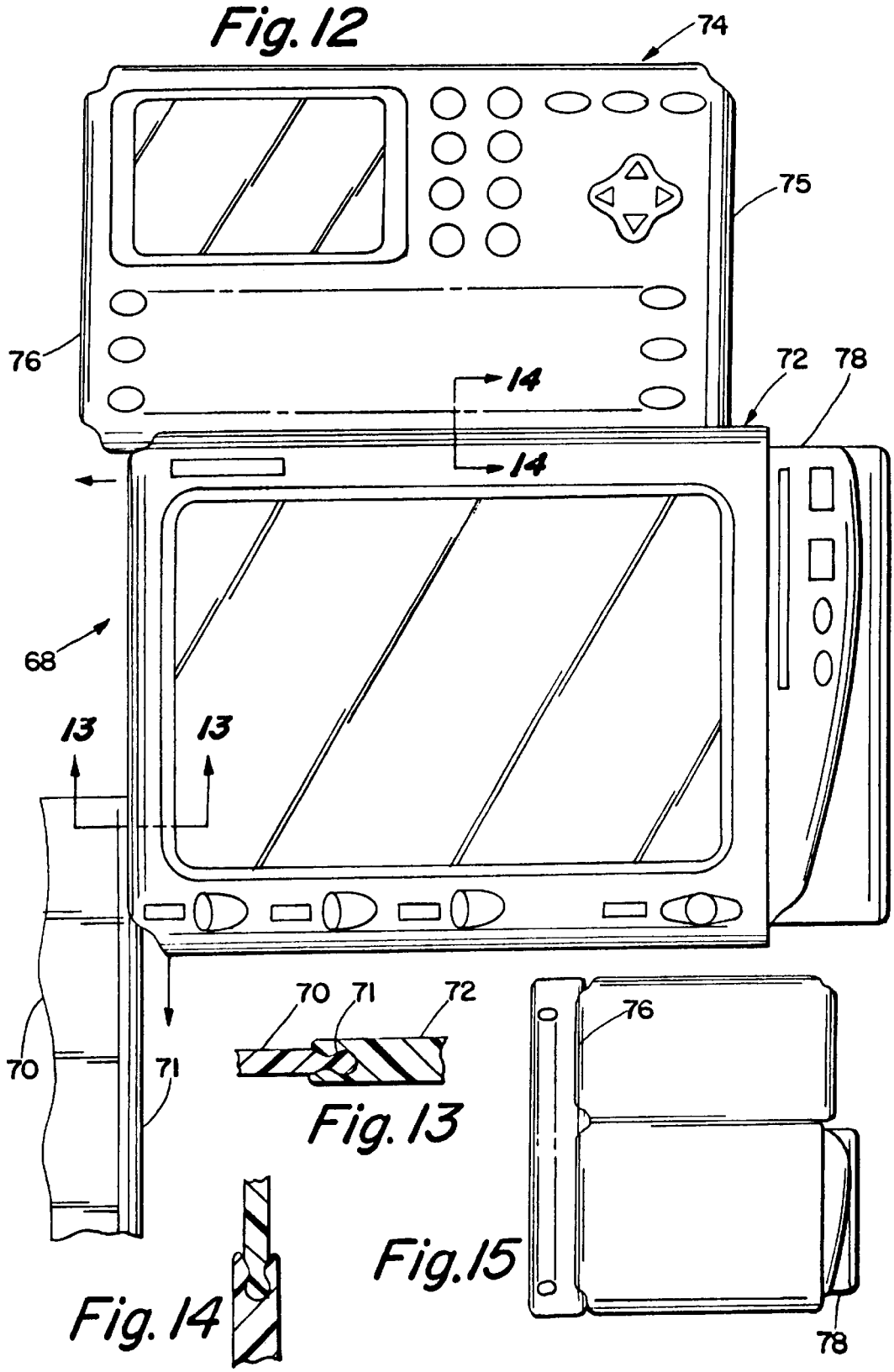
FIG. 12 is a front perspective view of an adapter supporting a television or internet access device and a databank/calculator, in accordance with the principles of the present invention.
FIG. 13 is a view taken along Line 13—13 of FIG. 12.
FIG. 14 is a view taken along Line 14—14 of FIG. 12.
FIG. 15 is a schematic front perspective view of the assembly of FIG. 12 in which the databank/calculator has been slid to cooperate with the adapter.

Referring now to FIGS. 12–14, another embodiment is illustrated, designated generally as 68. In this embodiment, an adapter 70 is utilized to slidably engage a selected item 72 such as a television or internet access device. This selected device 72, in turn, engages another modular connecting device 74, such as an electronic organizer. The means for attaching the modular connecting device to the device 74 to the selected device 72 may include, for example, sliding engagement means. Although such sliding engagement means are shown in this figure, it is understood that various combinations of attaching means described in this Application may alternatively be used.

FIG. 15 shows the modular connecting device 74 actually connected directly to the adapter 70. Such a connection is made via an adapter connecting means 76. The selected device 72 may have, for example, a male adapter 78 for connecting other devices.

It is noted that if, for example, the devices 74 and 72 are left unconnected, the device (e.g. electronic organizer 74) can be changed over from a right-side to a left-side orientation by sliding the device 74 longitudinally along the slide engaging member 71 of the adapter 70 until the first slide portion 76 slides out of engagement with the slide engaging member 71. The device 74 can then be flipped over to engage the second slide portion 75 with the slide engaging member 71, then slid in the second slide portion 75 along the slide engaging member 71 until the body 74 is fully engaged with the insert 70. Similar right side to left side orientations can be made with many of the other embodiments shown and described in this Application.

Referring now to FIG. 16, another embodiment of the present invention, is illustrated designated generally as 80, shown engaged to the rings 81 of a ringed binder. Embodiment 80 includes an adapter 82. An electronic template pen-based organizer 84 and memory storage device 86 attach to the adapter 82. A snap-in holder 88 attaches to the adapter 82. Batteries 90 are stored within the snap-in holder 88. The assembly 80 also includes a cable connector 92 and jack 94. A memory card 96, commonly known as flash memory, such as PCMICA, may be used. A latch 98 secures the memory storage device 86. FIG. 17 shows a possible means for attaching, that is, a sliding means.

FIG. 18 illustrates the use of a pager 100 with the principles of the present invention. The pager 100 has openings 102 on one side for engagement with rings 104 of a notebook. The other side of the pager 100 has openings 106 for engagement with other devices, as will be discussed in detail below. The pager includes normal pager buttons 108, 110, 112. It also includes a display 114.

FIGS. 19 and 20 illustrate the manner in which openings on both sides of the device serve to provide the functions of both connecting to the rings of the binder and also serving as a connector mechanism to another item. In FIG. 19, a calculator 116 has openings 118 for the rings 120 of a binder. On its opposite side it has another series of openings 122. Another selected item, e.g. appointment clock 124, is positioned adjacent to the calculator 116. As can be best seen in FIG. 20, a male element 126 of the calculator 116 fits into the female periphery 128 of the clock 124. Thus, the calculator 116 effectively serves as an "adapter" with its male periphery 126 serving to support the clock 124. The female element 128 has inwardly extending nipples 130 that engage the second plurality of spaced openings 122 in the calculator 116. The holes 132 in the appointment clock 124, in this modular combination, remain effectively unused. However, if one were to, for example, find that the calculator is not needed, the appointment clock 124 could be connected directly to rings 120 of the binder. It is understood that this type of male/female modular connection, although described specifically with respect to a calculator and clock, as with the other examples, may be implemented with other types of desired elements.

Figure 21:
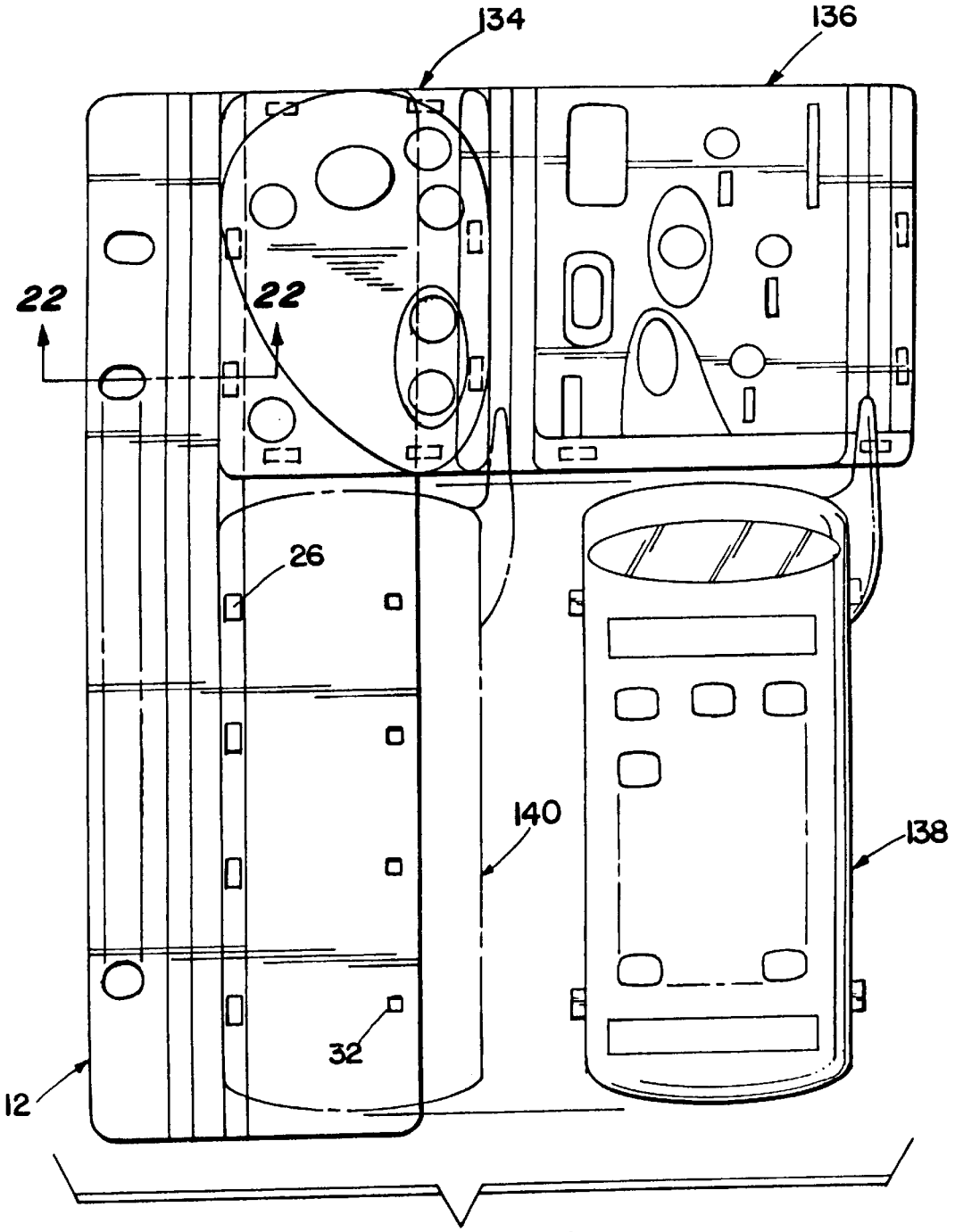
FIG. 21 is a exploded, front perspective view of a digital camera and sound recorder attached to an adapter in accordance with the present invention. (A cellular phone is also integrated in this combination.)
Figure 22:
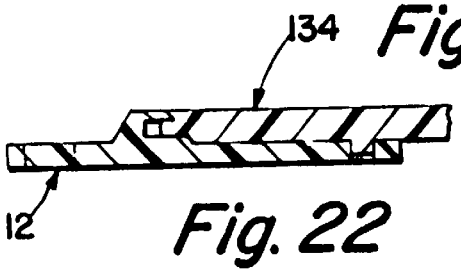
FIG. 22 is a view taken along Line 22—22 of FIG. 21.

Referring now to FIG. 21, implementation of the principles of the present invention to a sound recorder 134 is illustrated. In this example, the sound recorder 134 is attached to an adapter 12 of the type illustrated in FIGS. 1–4. A digital camera 136 is attached, in tum, to the sound recorder 134. A small cellular phone 138 is attachable to the adapter 12 as indicated by phantom lines 140. Thus, various devices are connected together in a configuration desired by the user.

Figure 23:
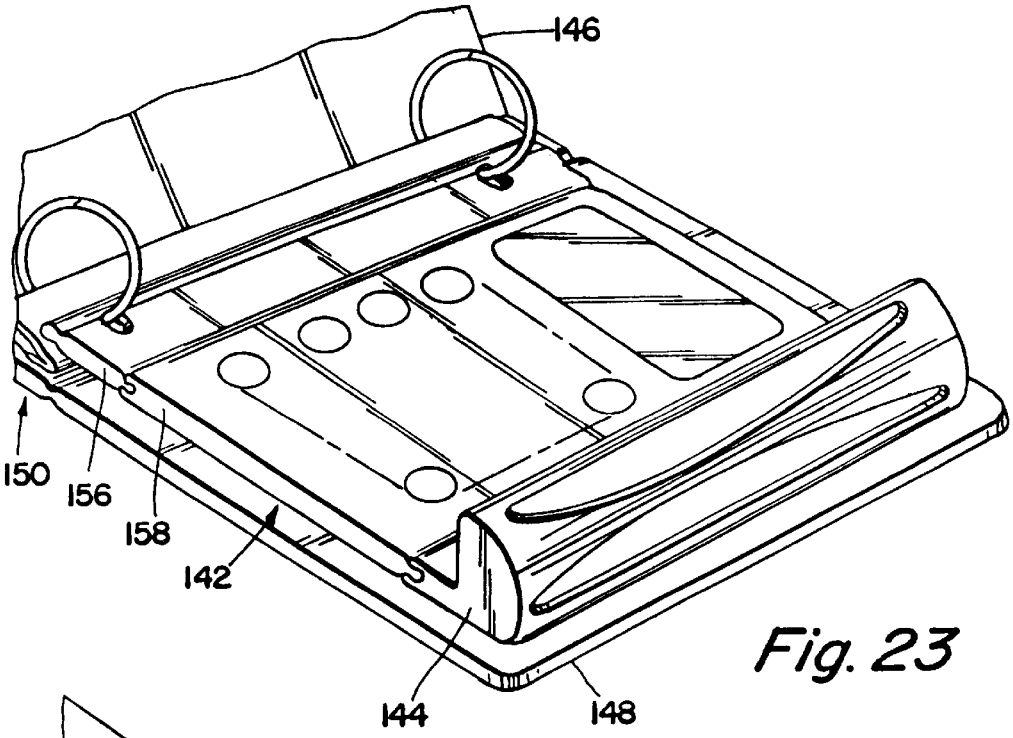
FIG. 23 is a perspective view of an organizer insert assembly which utilizes an adapter, an electronic unit and a printer or scanner.

Referring now to FIG. 23, an organizer assembly is illustrated which includes an organizer insert assembly 142 which has a terminal section 144 thereon which extends beyond the perimeter of the looseleaf pages. The terminal section 144 has increased thickness so as to fill a portion of the void between the front cover 146 and the rear cover 148 of the binder, designated generally as 150.

Figure 24:
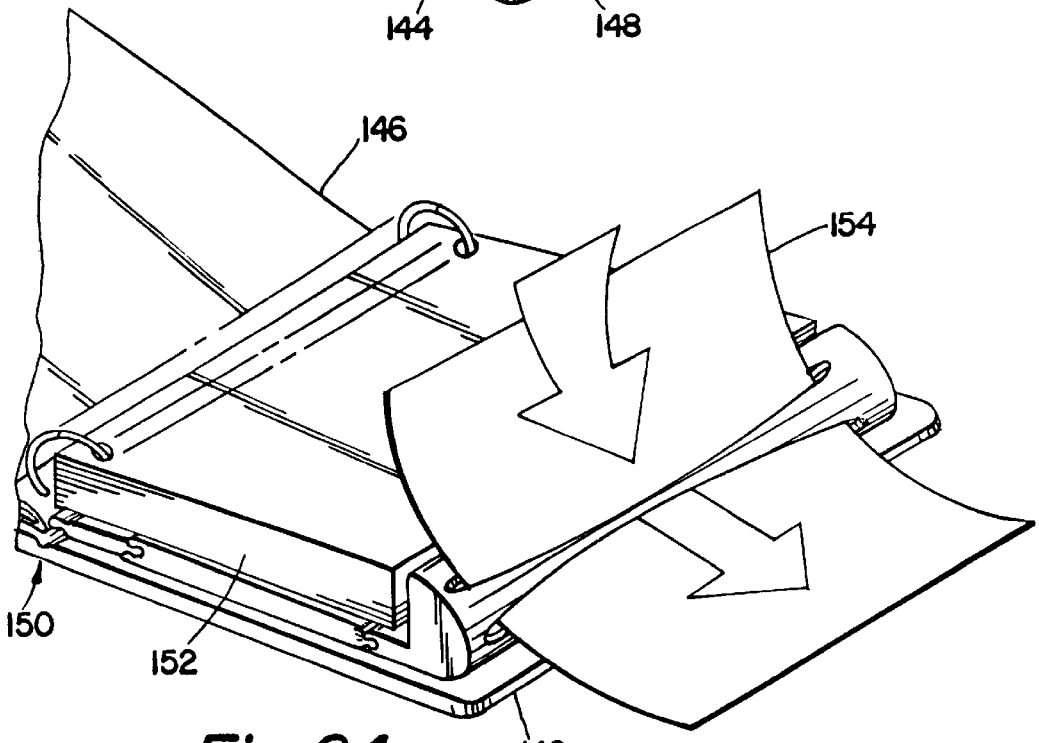
FIG. 24 shows the assembly of FIG. 23 with pages inserted in the notebook and a page being inserted through the scanner.

Referring to FIG. 24, a binder 150 is illustrated with looseleaf sheets 152 therein to illustrate the manner in which this void, beyond the looseleaf sheets 152 between the front cover 146 and rear cover 148, may be filled. In this example, the terminal section 144 comprises a printer or a scanner, a sheet of paper 154 shown being inserted within. Various combinations may be used to locate the terminal section 144. In the example shown in FIGS. 23 and 24 an adapter 156 is utilized with an electronic unit 158.

FIGS. 25 and 26 illustrate another embodiment of the present invention, designated generally as 160. In this embodiment the right side adapter 162 comprises a plate member having channels 164 formed in edges thereof. The selected item, for example, a generic electronic device 166 comprises a slotted portion 168 profiled to provide a complementary sliding fit when engaged with an edge portion 170 of the adapter 162. A peg element 172 is transversely positioned within the selected item 166 for engagement within the channel 164 such that the channel 164 and peg element 172 cooperate to restrict relative movement between the adapter 162 and the device 166. A left side adapter 174 has openings.

Referring now to FIG. 27 the adapter 174 can be used in an organizer assembly for removable attachment of selected items to each other for ultimate attachment to a host ringed notebook or ringed binder. Adapter 174 comprises a plate member 176 having first and second side edges, the first side edge including first attachment means 178 for attaching an edge of a first selected item (not shown) to the plate member 176. The second side edge includes second attachment means 180 for attaching an edge of a second selected item (also not shown) to the plate member 176. The first and second attachment means 178, 180 comprise male elements which can provide attachment to female side edges of such selected items. Although male elements have been shown, other suitable attachment means may be used, for example, female elements.

Referring now to FIG. 28, another adapter is illustrated, designated generally as 182. In this embodiment, releasable hinge assemblies 184 are utilized with a plate member 186.

In the FIG. 29 embodiment, designated generally as 188, a plate member 190 is used having openings 192 for the rings of the ring binder. Releasable hinge assemblies 194 are also used with this embodiment.

Figure 30:
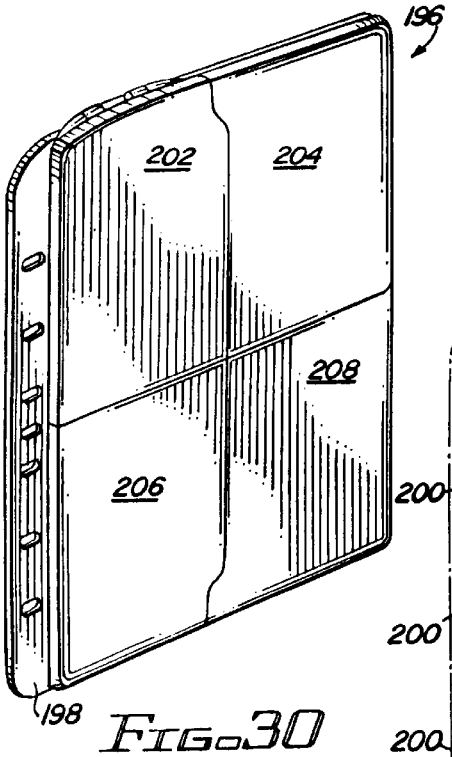
FIG. 30 is a front perspective view of modular devices connected to an adapter as an assembly, via releasable hinges, the entire assembly being shown in a closed position.
Figure 31:
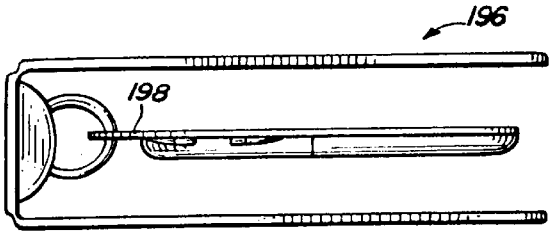
FIG. 31 shows the assembly of FIG. 30 inserted in a notebook.
Figure 32:
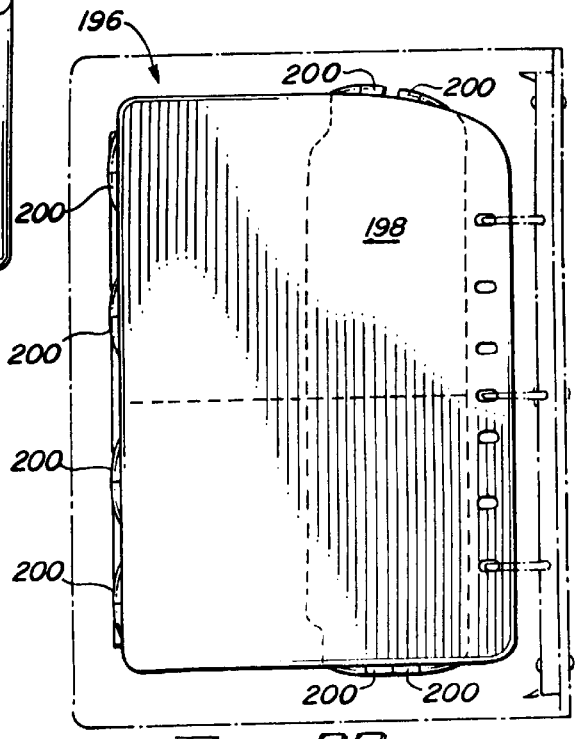
FIG. 32 is a cutaway back view of the notebook showing the assembly of FIG. 30 attached therein.

Referring now to FIGS. 30–32, another embodiment of the present invention is illustrated, designated generally as 196. The organizer assembly 196 includes an adapter 198. Releasable hinge assemblies 200 are located about the periphery of the plate member 198 for connecting selected items 202–208. Thus, when these selected items 202–208 are in stowed positions, as indicated in FIGS. 30–32, these selected items 202–208 are positioned against the plate member 198 to provide protection of these items.

Referring now to FIGS. 33–37, it can be seen that when the selected items 202–208 are rotated to operative positions, they become positioned outside the perimeter of the plate member 198 to provide an extended work area for the user which does not interfere with the use or rotation of any paper within the ringed notebook or ringed binder.

The various items that may be attached include, for example, a pen and pencil holder 202, a calculator 204, a memo recorder 206, and a clock 208.

Figure 38:
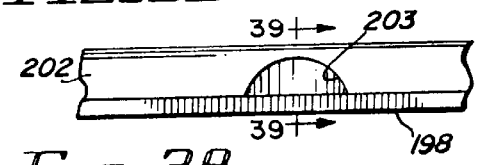
FIG. 38 is a fragmentary portion of the outside of a selected item showing an indent to aid in lifting the selected item up.
Figure 39:
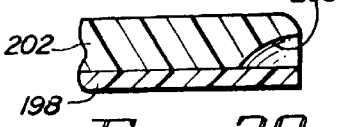
FIG. 39 is a view taken along Line 39—39 of FIG. 38.

Referring now to FIGS. 38 and 39, it can be seen that an indent 203 may be utilized to lift the device up.

Figures 33, 34, 35, 36, 37, 40, 41:
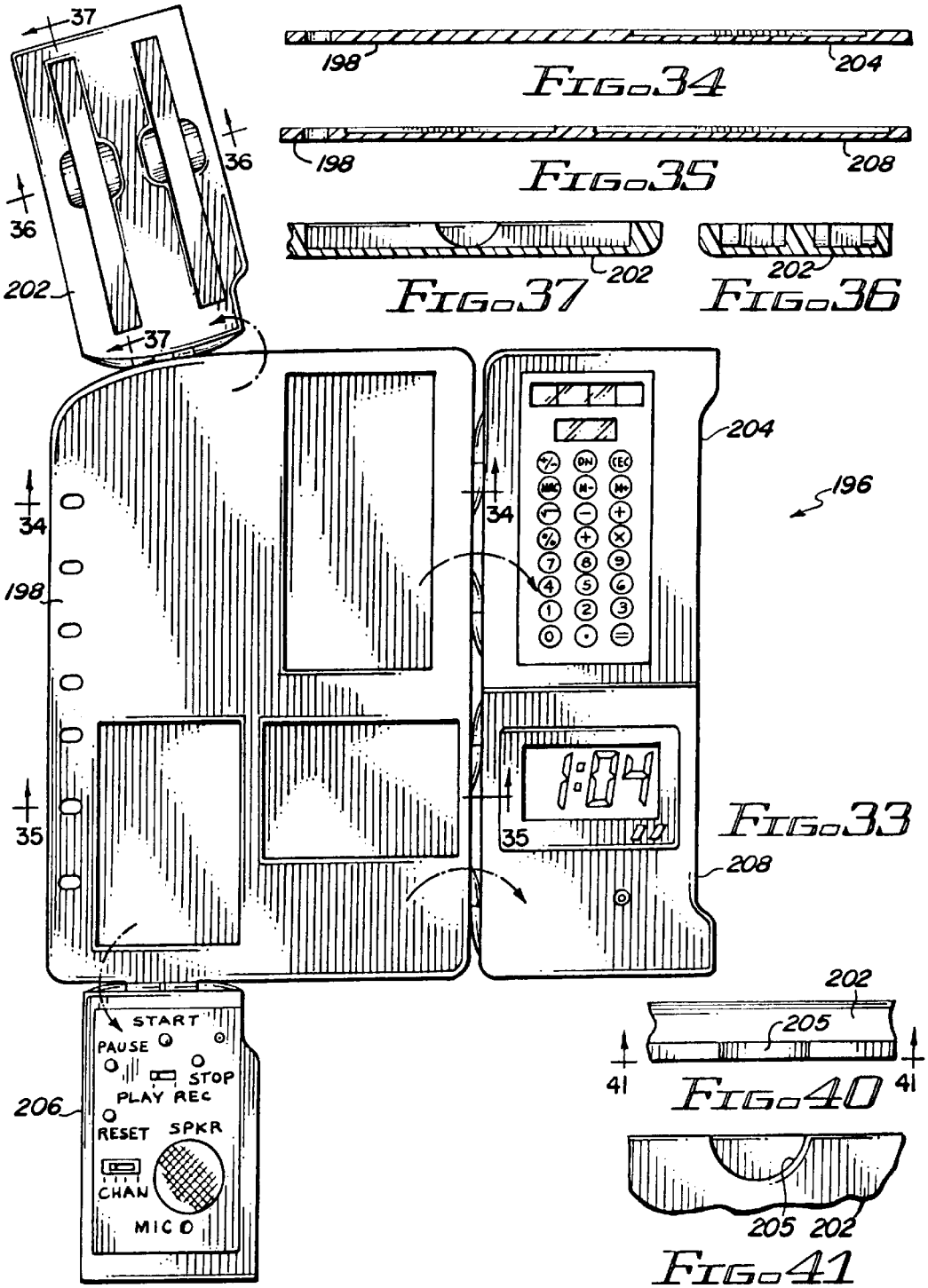
FIG. 33 shows the FIG. 30 assembly in an open position.
FIG. 34 is a view taken along Line 34—34 of FIG. 33.
FIG. 35 is a view taken along Line 35—35 of FIG. 33.
FIG. 36 is a view taken along Line 36—36 of FIG. 33.
FIG. 37 is a view taken along Line 37—37 of FIG. 33.
FIG. 40 shows the indent in an upside down orientation.
FIG. 41 is a view taken along Line 41—41 of FIG. 40.

Referring now to FIGS. 40 and 41, it can be seen that a indent or finger hole 205 can be formed upside down from the FIG. 38 orientation.

FIGS. 42–45 show an embodiment similar to that of FIG. 33, designated generally as 210, however the electronic and other selected devices have been removed from their housings to illustrate how selected devices may be positioned into desired positions from a base assembly.

Figures 42, 43, 44, 45:
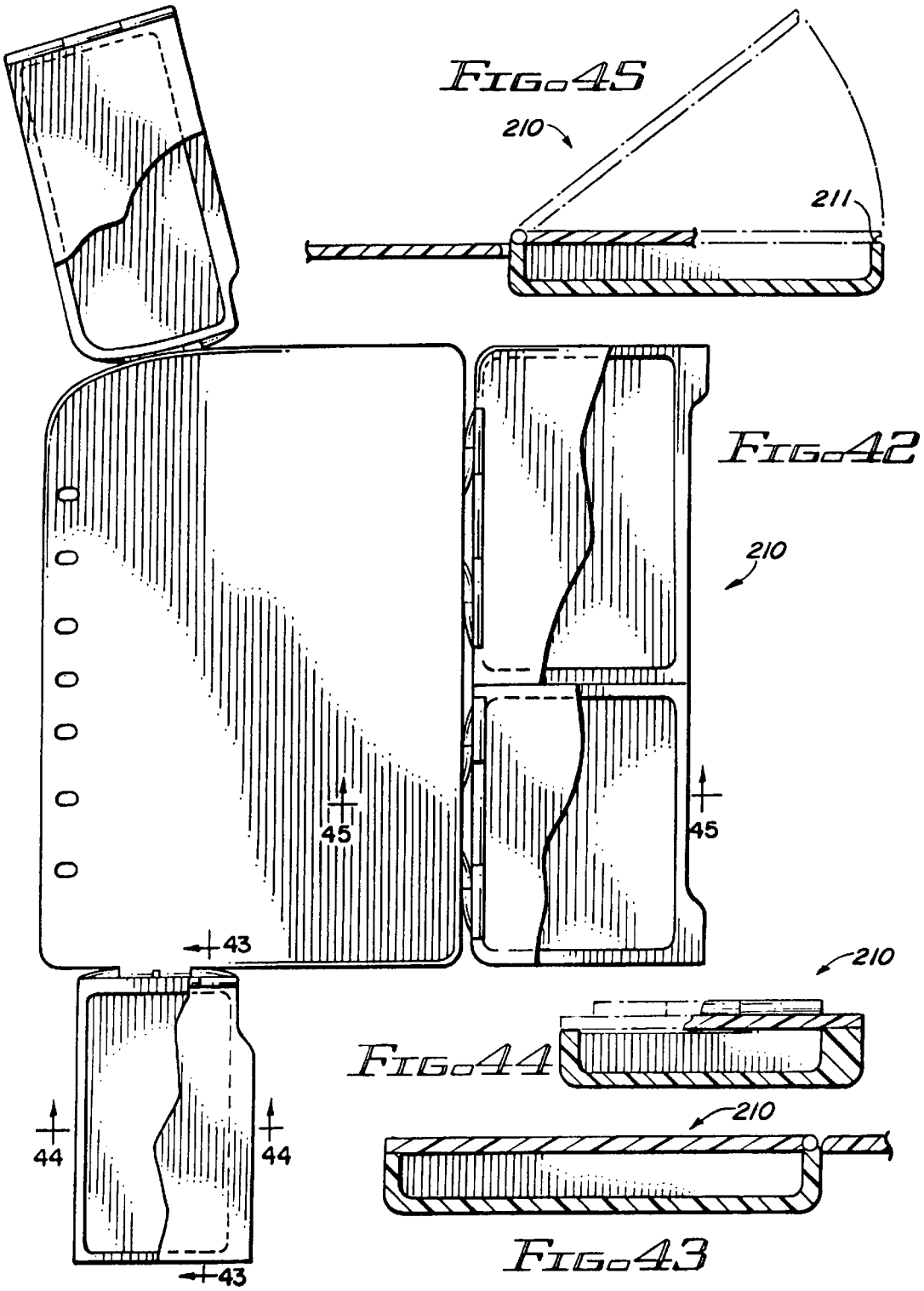
FIG. 42 is a perspective illustration of an embodiment similar to that of FIG. 33, with the electronic components omitted.
FIG. 43 is a view taken along Line 43—43 of FIG. 42.
FIG. 44 is a view taken along Line 44—44 of FIG. 42.
FIG. 45 is a view taken along Line 45—45 of FIG. 42.

FIG. 45 shows a finger notch 211.

Figure 46:
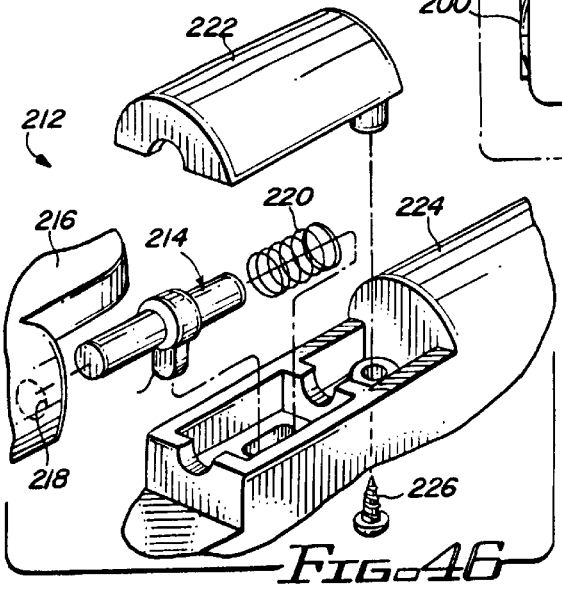
FIG. 46 is an exploded perspective view of a releasable hinge assembly in accordance with the principles of the present invention.

Referring now to FIG. 46, a releasable hinge assembly in accordance with the principles of the present invention is illustrated, designated generally as 212. The removable hinge assembly 212 includes a "T"-shaped pin 214 which is biased in the direction of a selected device 216 through a hole 218 by a spring 220. A cover plate 222 is affixed to an adapter 224 by a screw 226. The knob 228 of the pin 214 is pushed to release the pin 214 allowing for removal of the selected device 216.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An organizer assembly for removable attachment to a host ringed notebook or ringed binder having a plurality of rings, said ringed notebook or ringed binder being of the type having a front cover and rear cover with looseleaf pages positionable therebetween, said looseleaf pages having smaller perimeters than said covers, said organizer assembly comprising:

an organizer insert assembly attachable to the rings of said ringed binder or ringed notebook, said insert assembly comprising a relatively thin plate member having a side edge, said insert assembly further having a terminal section thereon which depends from the side edge and which extends beyond the perimeter of said looseleaf pages, said terminal section having an increased thickness so as to fill a portion of a void between the front and rear covers.

2. The organizer assembly of claim 1, wherein said terminal section comprises a printer.

3. The organizer assembly of claim 1, wherein said terminal section comprises a scanner.

4. The organizer assembly of claim 1, wherein said terminal section comprises an electronic unit.

5. The organizer assembly of claim 1, wherein said terminal section comprises a tape dispenser unit.

* * * * *